US009305702B2

(12) United States Patent
Sasamori et al.

(10) Patent No.: US 9,305,702 B2
(45) Date of Patent: Apr. 5, 2016

(54) SURFACE-MOUNT INDUCTOR AND PRODUCTION METHOD THEREOF

(71) Applicant: TOKO, INC., Tsurugashima-shi (JP)

(72) Inventors: Kunio Sasamori, Higashimatsuyama (JP); Masaaki Totsuka, Tsurugashima (JP); Chitoshi Sakai, Kawagoe (JP); Naoto Takahashi, Tsurugashima (JP); Hiroyasu Mori, Kawagoe (JP)

(73) Assignee: TOKO, INC., Saitama (JP)

( * ) Notice: Subject to any disclaimer, the term of this patent is extended or adjusted under 35 U.S.C. 154(b) by 0 days.

(21) Appl. No.: 14/015,477

(22) Filed: Aug. 30, 2013

(65) Prior Publication Data

US 2014/0062638 A1 Mar. 6, 2014

(30) Foreign Application Priority Data

Aug. 31, 2012 (JP) ..... 2012-191117

(51) Int. Cl.

| | |
|---|---|
| ***H01F 27/02*** | (2006.01) |
| ***H01F 5/00*** | (2006.01) |
| ***H01F 27/28*** | (2006.01) |
| ***H01F 27/24*** | (2006.01) |
| ***H01F 7/06*** | (2006.01) |
| ***H01F 41/06*** | (2006.01) |
| ***H01F 27/29*** | (2006.01) |
| *H01F 17/04* | (2006.01) |

(52) U.S. Cl.

CPC ..... *H01F 41/0612* (2013.01); *H01F 27/2847* (2013.01); *H01F 27/292* (2013.01); *H01F 2017/048* (2013.01); *Y10T 29/49071* (2015.01)

(58) Field of Classification Search

USPC ..... 336/175, 200, 232, 83, 233; 29/602.1, 29/605, 606

See application file for complete search history.

(56) References Cited

U.S. PATENT DOCUMENTS

| | | | |
|---|---|---|---|
| 2010/0259353 | A1 | 10/2010 | Saito et al. |
| 2013/0033348 | A1 | 2/2013 | Saito et al. |

FOREIGN PATENT DOCUMENTS

| | | | | |
|---|---|---|---|---|
| JP | 2009-170488 | | | 7/2009 |
| JP | 2009170488 | A | * | 7/2009 |
| JP | 2010-245473 | | | 10/2010 |
| WO | WO 2012105489 | A1 | * | 8/2012 |

* cited by examiner

*Primary Examiner* — Tsz Chan

(74) *Attorney, Agent, or Firm* — Cozen O'Connor

(57) ABSTRACT

[Technical Problem]

This invention provides a surface-mount inductor that is capable of positioning a coil in a predetermined position in a mold, thereby to position the coil in a predetermined position of a core and to prevent led-out ends from being buried in the core.

[Solution to the Problem]

A surface-mount inductor of the present invention comprises: a coil formed by winding a winding wire; and a core containing a magnetic powder and including the coil therein. The coil has opposite led-out ends, each of which is exposed on respective ones of opposed side surfaces of the core. Each of the led-out ends of the coil is connected to an external electrode formed on the core.

6 Claims, 3 Drawing Sheets

SURFACE-MOUNT INDUCTOR AND PRODUCTION METHOD THEREOF

TECHNICAL FIELD

The present invention relates to a surface-mount inductor comprising: a coil formed by winding a winding wire; and a core containing a magnetic powder and including the coil therein, and to a method of producing the inductor.

BACKGROUND ART

A conventional surface-mount inductor includes a type which is obtained by: winding a winding wire to form a coil; and forming a core while allowing the coil to be included therein, through pressure molding using a magnetic powder and binder, or compressing molding using a composite material of a magnetic powder and a resin. External terminals are formed on the surface of the core, and the coil is connected therebetween.

This conventional surface-mount inductor is formed, as illustrated in FIG. 6, by: disposing a coil 61, formed by winding a winding wire, on an E-shaped tablet 62A formed from a composite material of a magnetic powder and a resin; housing the coil 61 and the E-shaped tablet 62A in a mold comprising an lower mold 60A and an upper mold 60B such that each of led-out ends 61A, 61B of the coil 61 is sandwiched between the E-shaped tablet 62A and respective ones of inner walls of the mold; disposing a tablet 62B formed from a composite material of a magnetic powder and a resin on the tablet 62A; and thermally compressing them with the mold and a punch 60C (see, for example, the Patent Document 1).

This conventional surface-mount inductor may also be formed, as illustrated in FIG. 7, by: housing a coil 71, formed by winding a winding wire, in a mold comprising an lower mold 70A and an upper mold 70B; holding led-out ends 71A, 71B of the coil 61 with the lower mold 70A and the upper mold 70B; and filling a magnetic powder and binder in the mold and subjecting them to a pressure molding performed with the mold and a punch 70C at a high pressure, or disposing a composite material of a magnetic powder and a resin on upper and lower regions of the coil 71 in the mold and thermally compressing them with the mold and the punch 70C (see, for example, the Patent Document 2).

LIST OF PRIOR ART DOCUMENTS

Patent Documents

Patent Document 1: JP 2010-245473A
Patent Document 2: JP 2009-170488A

SUMMARY OF THE INVENTION

Technical Problem

In the conventional surface-mount inductor formed by using an E-shaped tablet, the E-shaped tablet may allow the coil to be disposed in a predetermined position in a mold, and prevent the coil from being displaced from a predetermined position in the core, or prevent the led-out ends from being buried in the core. However, when it is required to downsize the E-shaped tablet along with downsizing of the surface-mount inductor, it is difficult for such a conventional surface-mount inductor to form the E-shaped tablet due to its complicated shape. Even when the E-shaped tablet can be formed, there is a problem with the tablet that it is likely to be broken when the coil is mounted thereon or it is housed in the mold because it is impossible to keep the strength needed for mounting the coil thereon or for handling the tablet when housed in the mold. To keep the strength of the E-shaped tablet, it is necessary to make the thickness between outer surfaces of the tablet and the coil greater. However, this results in larger size of the surface-mount inductor, or limited size of the coil, and thus sufficient characteristics are often unobtainable.

On the other hand, in the conventional surface-mount inductor formed by holding the led-out ends of the coil by the mold, the mold may allow the coil to be disposed in a predetermined position in a mold, and prevent the coil from being displaced from a predetermined position in the core, or prevent the led-out ends from being buried in the core. However, such a conventional surface-mount inductor has a problem with generation of a large burr in the core due to a leakage of materials constituting the core from a portion of the mold which holds the led-out ends of the coil. In the event of generation of the large burr in the core, it is difficult to remove the burr because of the small size of the surface-mount inductor.

It is therefore an object of the present invention to provide a surface-mount inductor and a method of producing the inductor, where the surface-mount inductor is capable of positioning a coil in a predetermined position in a mold, thereby to position the coil in a predetermined position of a core and to prevent led-out ends from being buried in the core without using any special components or expensive units.

Solution to the Problem

The present invention provides a surface-mount inductor comprising: a coil formed by winding a winding wire; and a core containing a magnetic powder and including the coil therein, wherein each of opposite led-out ends of the coil is exposed on respective ones of opposed side surfaces of the core, and each of the led-out ends of the coil is connected to an external electrode formed on the core.

The present invention also provides a method of producing a surface-mount inductor which comprises: a coil formed by winding a winding wire; and a core containing a magnetic powder and including the coil therein, wherein the coil is processed to allow each of opposite led-out ends thereof to come into contact with respective ones of opposed inner walls of a mold.

Effect of the Invention

According to the present invention, there is provided a surface-mount inductor comprising: a coil formed by winding a winding wire; and a core containing a magnetic powder and including the coil therein, wherein each of opposite led-out ends of the coil is exposed on respective ones of opposed side surfaces of the core, and each of the led-out ends of the coil is connected to an external electrode formed on the core. This makes it possible to position the coil in a predetermined position of the core to ensure the coil to be connected to external electrodes without using any special components or expensive units.

According to the present invention, there is also provided a method of producing a surface-mount inductor which comprises: a coil formed by winding a winding wire; and a core containing a magnetic powder and including the coil therein, wherein the coil is processed to allow each of opposite led-out ends thereof to come into contact with respective ones of opposed inner walls of a mold. This makes it possible to position the coil in a predetermined position in the mold, thereby to position the coil in a predetermined position of the core and to expose the led-out ends on predetermined positions in a core surface without using any special components or expensive units.

DESCRIPTION OF EMBODIMENTS

A surface-mount inductor of the present invention comprises a coil formed by winding a winding wire, and a core containing a magnetic powder and including the coil therein. The coil has opposite led-out ends, each of which is exposed on respective ones of opposed side surfaces of the core, and each of the led-out ends of the coil is connected to an external electrode formed on the core.

Thus, in this surface-mount inductor, the coil position in the core can be determined by the led-out ends, so that it is not necessary to use a complicated shape of tablet or to use a particular kind of mold. Further, this surface-mount inductor does not use any complicated shape of tablet, and thus the coil size can be freely set within the range of core size. This makes it possible to provide contribution in improvement of inductance value, DC resistance value, efficiency, characteristics such as DC superimposition characteristics, and in downsizing of the surface-mount inductor.

A method of producing a surface-mount inductor of the present invention comprises forming a coil by winding a winding wire, and housing the coil and a material containing a magnetic powder in a mold to form a core including the coil therein. The coil has opposite led-out ends, each of which is processed to come into contact with respective ones of opposed inner walls of the mold.

Thus, in this method of producing a surface-mount inductor, the coil position in the mold can be determined by the led-out ends, so that the coil can be positioned in a predetermined position in the core, and the led-out ends can be exposed on predetermined positions in the core surface to ensure each of them to be connected to an external electrode without using a complicated shape of tablet or using a particular kind of mold. Further, this method of producing a surface-mount inductor does not use any complicated shape of tablet, and thus the coil size can be freely set within the range of core size. This makes it possible to provide contribution in improvement of inductance value, DC resistance value, efficiency, characteristics such as DC superimposition characteristics, and in downsizing of the surface-mount inductor.

[Embodiments]

Embodiments of the surface-mount inductor and the production method thereof according to the present invention will now be described with reference to FIGS. 1 to 5.

Figure 1:
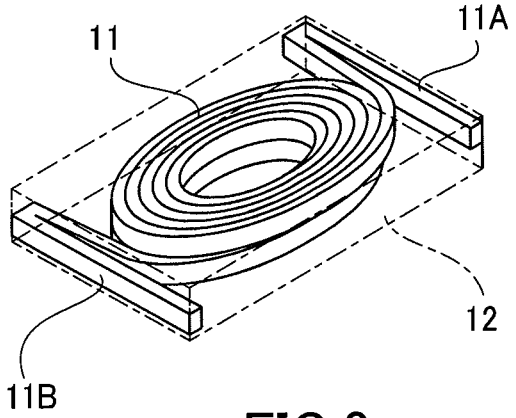
FIG. 1 is a transparent perspective view illustrating a first embodiment of a surface-mount inductor according to the present invention.

FIG. 1 is a transparent perspective view illustrating a first embodiment of a surface-mount inductor according to the present invention.

In FIG. 1, the reference numeral 11 designates a coil, and 12 designates a core.

The coil 11 is formed by winding a rectangular wire in two tiers to allow its opposite ends to be positioned on an outer periphery of the coil. The coil 11 is disposed in the core 12 described below, and is processed to allow each opposite end of the rectangular wire which is led out from the outer periphery of the coil to be exposed along an end surface and respective ones of two opposed side surfaces adjacent to the end surface of the core 12 to form led-out ends 11A and 11B.

Figure 2:
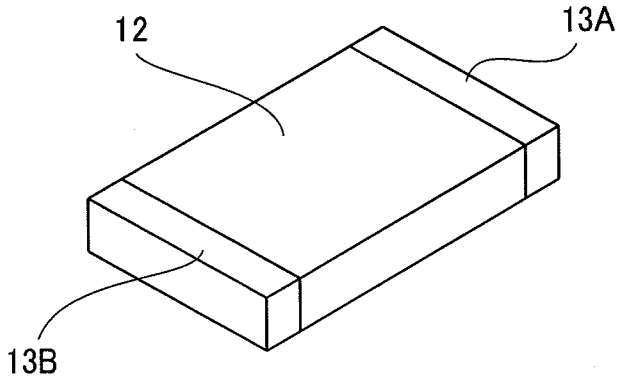
FIG. 2 is a perspective view of the surface-mount inductor according to the present invention.

The core 12 includes the coil 11 using a composite material of a magnetic powder and a resin, and is formed to allow each of the opposite led-out ends 11A and 11B of the coil 11 to be exposed on the end surface and respective ones of two side surfaces which are adjacent to the end surface and opposed to each other. For the magnetic powder, a metal magnetic powder is used. For the resin, an epoxy resin is used. External electrodes 13A and 13B are formed on the surface of the core 12, as illustrated in FIG. 2.

Then, the coil 11 is connected between the external electrodes 13A and 13B by the led-out ends 11A of the coil 11 being connected to the external electrodes 13A and the led-out ends 11B of the coil 11 being connected to the external electrodes 13B.

This surface-mount inductor is produced in the following manner. Firstly, a coil is formed by winding a rectangular wire in two tiers to allow its opposite ends to be positioned on an outer periphery of the coil.

Then, terminal ends of the rectangular wire positioned on an outer periphery of the coil are processed to allow each of them to be exposed along an end surface and respective ones of two opposed side surfaces adjacent to the end surface of the core to form led-out ends.

Figure 3:
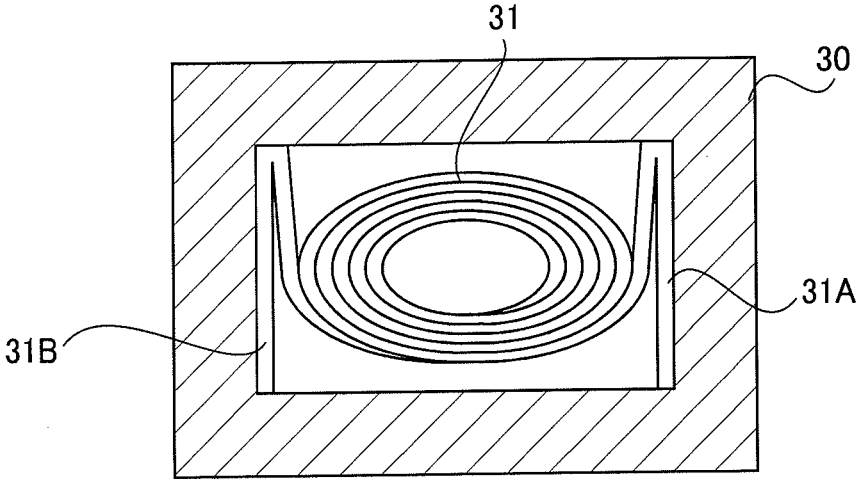
FIG. 3 is a partial cross-sectional view illustrating a first embodiment of a method of producing the surface-mount inductor according to the present invention.

Next, as illustrated in FIG. 3, the coil 31 is housed in a mold 30 to allow each of the surfaces of its led-out ends 31A, 31B to be along and in contact with respective ones of opposed inner walls and an inner wall adjoining to both of the opposed inner walls of the mold 30. At this time, a tablet made by pre-forming a composite material of an iron-based metal magnetic powder and an epoxy resin into a plate is preliminarily housed in an inner bottom surface of the mold 30, in which the coil 31 is housed.

Further, the composite material of an iron-based metal magnetic powder and an epoxy resin is filled in the mold 30 in which the coil 31 is housed, or the tablet made by pre-forming the composite material of an iron-based metal magnetic powder and an epoxy resin into a plate is housed in the mold 30 in which the coil 31 is housed.

Subsequently, these are subjected to a compression molding performed by the mold 30 and a punch at a temperature from 120 to 250° C., thereby to form a core 12 including the coil, where the core 12 is formed to allow each of the opposite led-out ends of the coil to be exposed on the end surface and respective ones of two side surfaces which are adjacent to the end surface and opposed to each other.

Then, an electrically-conductive paste is applied on the core 12 and cured to form external electrodes 13A, 13B on the core 12. The external electrodes 13A, 13B may be plated with a material formed by appropriately selecting one or more from materials such as Ni, Sn, Cu, Au and Pd.

Figure 4:
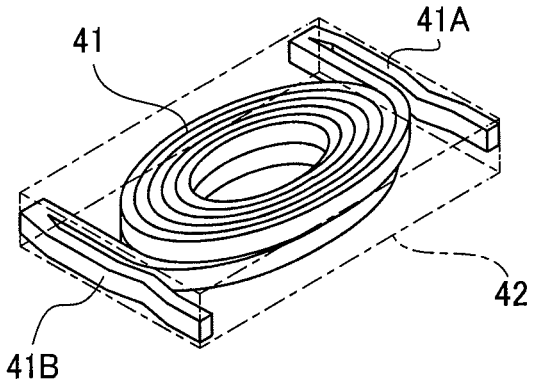
FIG. 4 is a transparent perspective view illustrating a second embodiment of the surface-mount inductor according to the present invention.

FIG. 4 is a transparent perspective view illustrating a second embodiment of a surface-mount inductor according to the present invention.

The coil 14 is formed by winding a rectangular wire in two tiers to allow its opposite ends to be positioned on an outer periphery of the coil. The coil 41 is disposed in the core 42, and is processed in a wave shape to allow each end of the rectangular wire which is led out from the outer periphery of the coil to be exposed on respective ones of opposed side surfaces of the core 42 to form led-out ends 41A and 41B.

The core 42 includes the coil 41 using a composite material of a magnetic powder and a resin, and is formed to allow each of the opposite wave-shaped led-out ends 41A and 41B of the coil 41 to be exposed on respective ones of two opposed side surfaces. For the magnetic powder, a metal magnetic powder is used. For the resin, an epoxy resin is used. External electrodes 13A and 13B are formed on the surface of the core, as illustrated in FIG. 2.

Then, the coil 41 is connected between the external electrodes 13A and 13B by the led-out ends 41A of the coil 41 being connected to the external electrodes 13A and the led-out ends 41B of the coil 41 being connected to the external electrodes 13B.

This surface-mount inductor is produced in the following manner. Firstly, a coil is formed by winding a rectangular wire in two tiers to allow its opposite ends to be positioned on an outer periphery of the coil.

Then, terminal ends of the rectangular wire positioned on an outer periphery of the coil are processed to allow each of them to be exposed on respective ones of opposed side surfaces of the core to form wave-shaped led-out ends.

Figure 5:
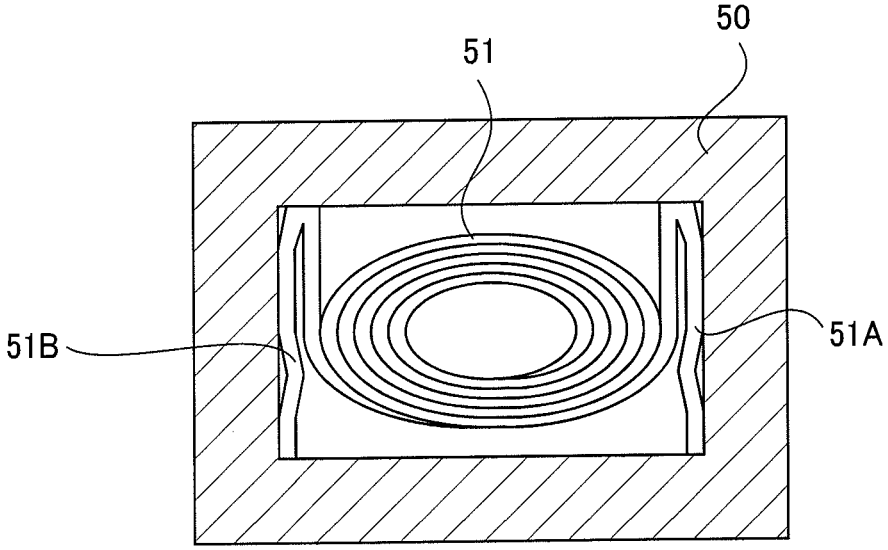
FIG. 5 is a partial cross-sectional view illustrating a second embodiment of the method of producing the surface-mount inductor according to the present invention.
Figure 6:
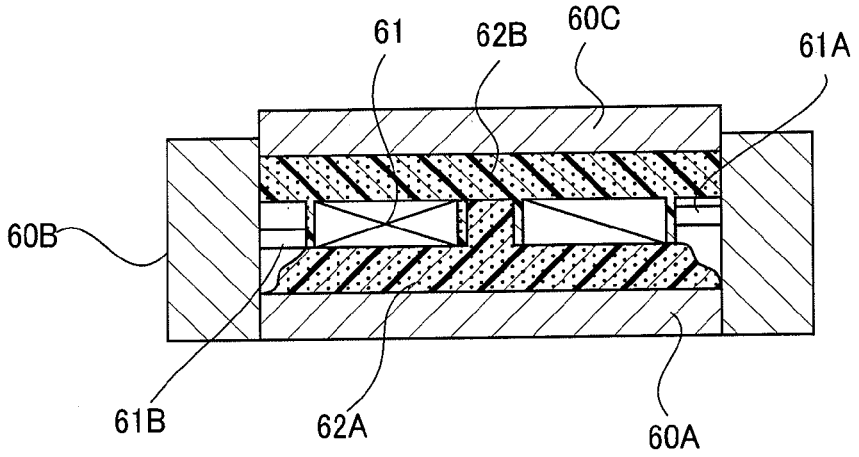
FIG. 6 is a partial cross-sectional view illustrating a method of producing a conventional surface-mount inductor.
Figure 7:
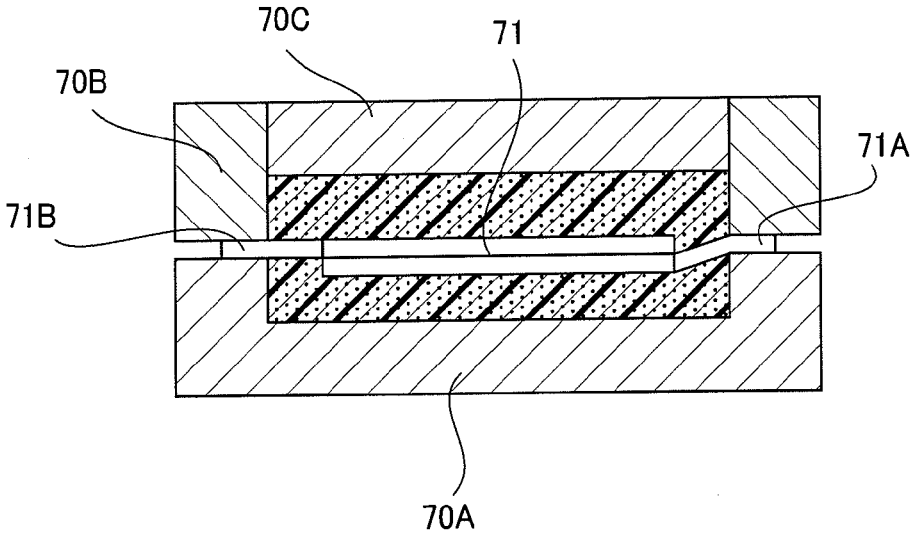
FIG. 7 is a partial cross-sectional view illustrating another method of producing a conventional surface-mount inductor.

Next, as illustrated in FIG. 5, the coil 51 is housed in a mold 50 to allow each of its opposite led-out ends 51A, 51B to come into contact with respective ones of opposed inner walls of the mold 50. The led-out ends 51A, 51B of the coil 51 are provided with spring characteristics because they are formed in a wave shape, so that the led-out ends 51A, 51B make contacts between the opposed inner walls of the mold 50 more strongly than those illustrated in FIG. 3.

Further, a composite material of an iron-based metal magnetic powder and an epoxy resin is filled in the mold 50 in which the coil 51 is housed.

Subsequently, these are subjected to a compression molding performed by the mold 50 and a punch at a temperature from 120 to 250° C., thereby to form a core 42 including the coil, where the core 42 is formed to allow each of the opposite led-out ends of the coil to be exposed on respective ones of two side surfaces opposed to each other.

Then, an electrically-conductive paste is applied on the core 42 and cured to form external electrodes on the core 42. The external electrodes may be plated with a material formed by appropriately selecting one or more from materials such as Ni, Sn, Cu, Au and Pd.

While embodiments of a surface-mount inductor and a production method thereof according to the present invention have been described above, the invention is not limited to the embodiments. For example, the metal magnetic powder for use in the core may have a wide variety of compositions, and may be a metal magnetic powder having a surface coated with an insulator such as a glass, or a metal magnetic powder having an oxidized surface. Further, the resin for use in the core may be other thermosetting resin such as a polyimide resin or a phenol resin, or may be a thermoplastic resin such as a polyethylene resin or a polyamide resin. Furthermore, the core may be formed by filling a magnetic powder and binder in a mold in which a coil is housed, and subjecting them to pressure molding performed with the mold and a punch at a high pressure. In this case, the magnetic powder for use in the core may be a metal magnetic powder, a metal magnetic powder having a surface coated with insulators such as a glass, or a metal magnetic powder having an oxidized surface.

Explanation of Codes

11: coil

12: core

What is claimed is:

1. A surface-mount inductor comprising:

a coil formed by winding a winding wire; and a core containing a magnetic powder and including the coil therein;

wherein the coil is formed by winding the wire such that opposite ends of the wire are positioned on an outer periphery of the coil, each opposite end of the wire being led out from the outer periphery where the wire is wound to form a first lead-out end and a second lead-out end, the first led-out end of the coil extending in the core between two opposed side surfaces of the core is exposed on the two opposed side surfaces of the core, the second led-out end of the coil extending in the core between the two opposed side surfaces of the core is exposed on the two opposed side surfaces of the core, the first led-out end of the coil exposed on the surface of the core is connected to a first external electrode formed on the core, and the second led-out end of the coil exposed on the surface of the core is connected to a second external electrode formed on the core.

2. The surface-mount inductor as defined in claim 1, wherein each of the led-out ends of the coil has elasticity.

3. A surface-mount inductor comprising:

a coil formed by winding a winding wire; and a core containing a magnetic powder and including the coil therein;

wherein the coil is formed by winding the wire such that opposite ends of the wire are positioned on an outer periphery of the coil, each opposite end of the wire being led out from the outer periphery where the wire is wound to form a first lead-out end and a second lead-out end, the first led-out end having a surface exposed on one end surface of the core extends to an opposed side surface of the core adjacent the end surface of the core to be exposed on the opposed side surface of the core, the second led-out end having a surface exposed on another end surface of the core extends to an opposed side surface of a core adjacent the end surface of the core to be exposed on the opposed side surface of the core, the first led-out end of the coil exposed on the surface of the core is connected to a first external electrode formed on the core, and the second led-out end of the coil exposed on the surface of the core is connected to a second external electrode formed on the core.

4. The surface-mount inductor as defined in claim 3, wherein each of the led-out ends of the coil has elasticity.

5. A method of producing a surface-mount inductor, comprising:

winding a winding wire to form a coil; and providing the coil and a magnetic powder within a core;

wherein the coil is formed by winding the wire such that opposite ends of the wire are positioned on an outer periphery of the coil, each opposite end of the wire being led out from the outer periphery where the wire is wound to form a first lead-out end and a second lead-out end, the first led-out is processed such that said first led-out end extends between a pair of two opposed inner walls of a mold and comes into contact with the two opposed inner walls of the mold, the second led-out end is processed such that said second led-out end extends between a pair of two opposed inner walls of the mold and comes into contact with the two opposed inner walls of the mold, the coil is disposed in the mold and is formed via said mold, a first external electrode and a second external electrode are formed on the core, the first led-out end of the coil extending in the core between two opposed side surfaces of the core and exposed on the two opposed side surfaces of the core is connected to the first external electrode formed on the core, and the second led-out end of the coil extending in the core between the two opposed side surfaces of said core and exposed on the two opposed side surfaces of the core is connected to the second external electrode formed on the core.

6. A method of producing a surface-mount inductor which comprises:

winding a winding wire to form a coil; and providing the coil and a magnetic powder within a core;

wherein the coil is formed by winding a wire such that opposite ends of the wire are positioned on an outer periphery of the coil, each opposite end of the wire is led out from the outer periphery where the wire is wound to form a first lead-out end and a second lead-out end, the first led-out end is processed such that said first led-out end extends between a pair of two opposed inner walls of a mold and comes into contact with both of the two opposed inner walls and another wall of the two opposed inner walls adjacent both of the opposed inner walls, the second led-out end is processed such that said second led-out end extends between a pair of two opposed inner walls of the mold and comes into contact with both of the two opposed inner walls and the other of the other pair of two opposed inner walls adjacent both of the two opposed inner walls, the coil is disposed in the mold and is formed via the mold, a first external electrode and a second external electrode are formed on the core, the first led-out end having a surface exposed on one end surface of the core and extending to an opposed side surface of the core adjacent an end surface of the core to be exposed on the opposed side surface of the core is connected to the first external electrode formed on the core, and the second led-out end having a surface exposed on the other end surface of the core and extending to an opposed side surface of the core adjacent the end surface of the core to be exposed on the opposed side surface of the core is connected to the second external electrode formed on the core.

* * * * *